United States Patent [19]

Nardi

[11] 4,288,117

[45] Sep. 8, 1981

[54] LOCK FOR MOTOR VEHICLE DOORS

[75] Inventor: Giovanni Nardi, Pisa, Italy

[73] Assignee: Whitehead Motofides, S.p.A., Via Salvatore Orlando, Italy

[21] Appl. No.: 969,676

[22] Filed: Dec. 15, 1978

[30] Foreign Application Priority Data

Mar. 10, 1978 [IT] Italy ..... 67515 A/78

[51] Int. Cl.[2] ..... E05C 13/00

[52] U.S. Cl. ..... 292/52; 292/DIG. 41

[58] Field of Search ..... 292/216, 52, 198, 213, 292/DIG. 40, DIG. 72, DIG. 41, 48

[56] References Cited

U.S. PATENT DOCUMENTS

| | | | |
|---|---|---|---|
| 1,597,510 | 8/1926 | Carrier | 292/DIG. 40 |
| 2,099,456 | 11/1937 | Sweet | 292/DIG. 40 |
| 3,058,766 | 10/1962 | Chanaryn et al. | 292/198 X |
| 3,321,231 | 5/1967 | DeCoye De Castelet | 292/198 |
| 3,563,588 | 2/1971 | Putsch et al. | 292/198 |
| 3,709,537 | 1/1973 | Kazaoka et al. | 292/DIG. 41 |

*Primary Examiner*—Richard E. Moore

*Attorney, Agent, or Firm*—Gifford, VanOphem, Sheridan & Sprinkle

[57] ABSTRACT

A lock for motor vehicle doors is described. The lock comprises a striker member arranged for engagement and disengagement by means comprised in a mechanism of said lock, the mechanism is supported by a first plate, and the striker member and means are disposed on a part fixed relative to the door and on the door respectively, or vice versa.

The main feature of this lock is that said means comprise at least one pair of engagement members for said striker which are rotatable on pins, and the disengagement load exerted between said member and said means is opposed only by component forces passing substantially through the axis of said pins.

25 Claims, 14 Drawing Figures

LOCK FOR MOTOR VEHICLE DOORS

BACKGROUND OF THE INVENTION

This invention relates to a lock for motor vehicle doors, of the type comprising a striker member generally fixed to the motor vehicle body and arranged to be engaged and disengaged by means comprised in a mechanism of said lock, which is substantially housed in the door. In said locks there are generally two positions of snap-engagement, and disengagement can occur either by operating an outer handle or by operating an inner control member. In addition, safety means are generally provided for preventing disengagement (either by way of the inner control means or the outer handle).

Such motor vehicle locks must offer a certain degree of protection against accidental opening, even under the action of large forces, as can occur during collisions. Thus, national and international standards have fixed the load values in a longitudinal and transverse direction (relative to the vehicle) which the lock must be able to resist. In particular, the withstandable transverse load (which is also the load which tends to disengage the means comprised in the lock mechanism from the striker member in the door opening direction) according to the international standards drawn up by the E.C.E. of Geneva must be at least equal to 453 Kgf in the first closure position, and 907 Kgf in the total closure position. The withstandable longitudinal load must be at least equal to 453 Kgf in the first closure position, and 1134 Kgf in the total closure position.

In known locks, the engagement between the striker member and the means comprised in the lock mechanism is generally obtained by forks. However, the disengaging load exerted between said striker member and the other parts of the lock mechanism, and generally acting in a transverse direction, can assume a very high value under the action of a violent impact following collision, and generates moments through said fork which have to be sufficiently opposed by the mechanism parts of the lock. In order to ensure proper safety even against stresses under very critical conditions, these known locks must be sized such that the various component pieces are of sufficient strength, and this leads to relatively large bulk.

SUMMARY OF THE INVENTION

The object of the present invention is to provide a lock for motor vehicle doors in which the disengaging load exerted between the striker member and the means comprised in the lock mechanism do not generate moments, so that smaller stresses arise under said disengaging load, and thus the lock itself ensures greater safety as it is able to offer greater resistance against forces, and is of more simple construction.

Further objects and advantages of the lock according to the present invention will be apparent from the description given hereinafter.

The present invention provides a lock for motor vehicle doors, comprising a striker member arranged for engagement and disengagement by means comprised in a mechanism of said lock, the mechanism being supported by a first plate, and the striker member and means being disposed on a part fixed relative to the door and on the door respectively, or vice versa, wherein said means comprise at least one pair of engagement members for said striker which are rotatable on pins, and the disengagement load exerted between said member and said means is opposed only by component forces passing substantially through the axis of said pins.

BRIEF DESCRIPTION OF THE DRAWINGS

The present invention will be more apparent from the description given hereinafter with reference to the accompanying drawings, which are provided by way of non-limiting example, and in which.

DETAILED DESCRIPTION OF THE INVENTION

Figure 1:
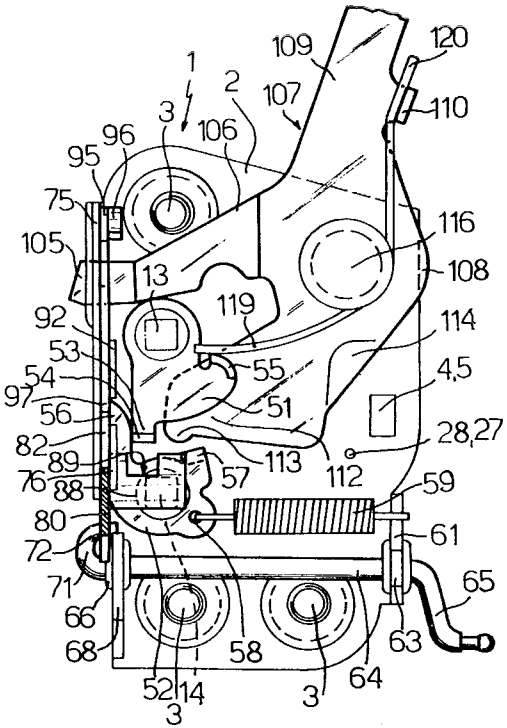
FIGS. 1 and 2 are a plan and side view respectively, of a first embodiment of the lock of the present invention, in the closed position.
Figure 10:
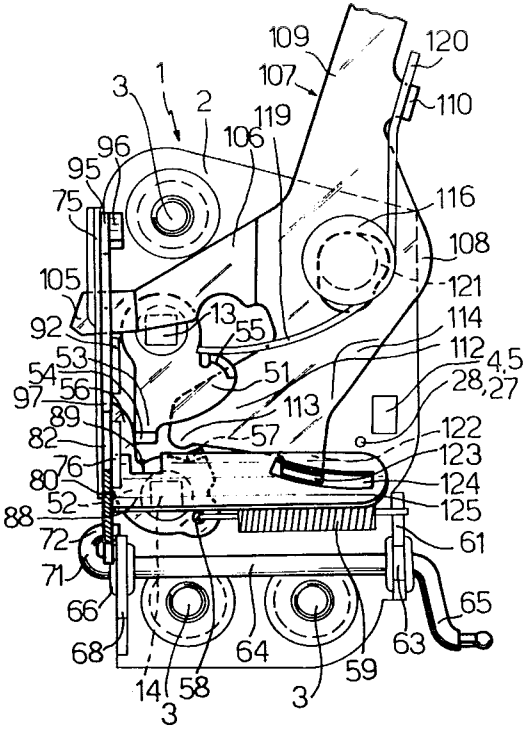
FIG. 10 is a plan view of a second embodiment of the lock of the present invention, in the closed position.

With reference to FIGS. 1 to 9, the lock according to the present invention comprises a support plate 1 which is bent at a right angle and supports the various lock mechanisms. The support plate 1 comprises a base plate 2 in which three bores 3 are provided for mounting the lock, for example to a motor vehicle door. Three slots 4 are also provided in the base plate 2, into which three appendices 5 of a casing 6 are inserted, this latter therefore being fixed to the lower wall of the base plate 2. The casing 6 comprises two lateral walls 7 (from which two of the appendices 5 branch outwardly). The walls 7 are inclined towards each other and towards a lateral base wall 8 of the casing 6 (from which the third appendix 5 branches), so as to define a substantially trapezoidal shape for the end region of the casing 6. The lateral end wall 8 is separated from the edges of the lateral walls 7, and defines two slots 9.

Figure 9:
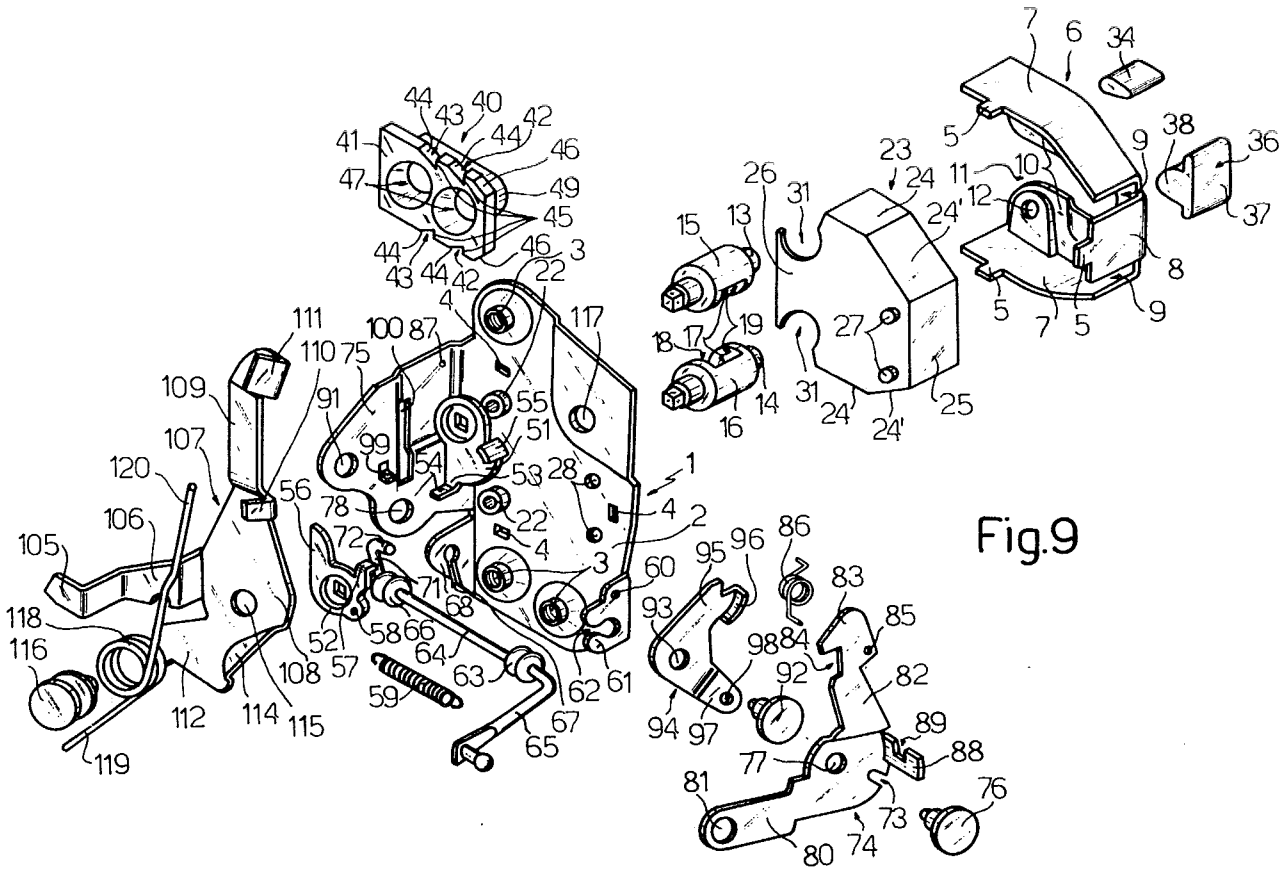
FIG. 9 is a perspective view of the lock of the present invention, with the parts separated.

The casing 6 is closed on the side opposite that comprising the appendices 5, by a base wall 10 provided with a longitudinal slot 11 (in the direction of the lateral walls 7). In the two regions of the base wall 10 in proximity to the lateral walls 7, there are provided two bores 12 into which are inserted the lower ends of two pins 13 and 14 which rigidly support two engaging members 15 and 16 of cylindrical shape. The engaging members have an intermediate portion removed along a diagonal plane to define a flat diagonal wall 17 and an upper and lower orthogonal plane 18 and 19 (FIG. 9). The upper ends of the two pins 13 and 14 are housed in two bosses 22 on the base plate 2 of the support plate 1. An inner member 23 is housed in the casing 6, and comprises lateral walls 24 and 24' and a lateral end wall 25 which on contact adapt respectively to the lateral walls 7 and lateral end wall 8 of the casing 6. The member 23 also comprises a base wall 26 arranged to rest on the lower wall of the base plate 2 of the support plate 1, and comprising two pegs 27 in proximity to the end wall 25, arranged for insertion into corresponding bores 28 provided in the base plate 2. The base wall 26 also comprises two semicircular apertures 31 for the passage of the engagement members 15 and 16.

Figure 7:
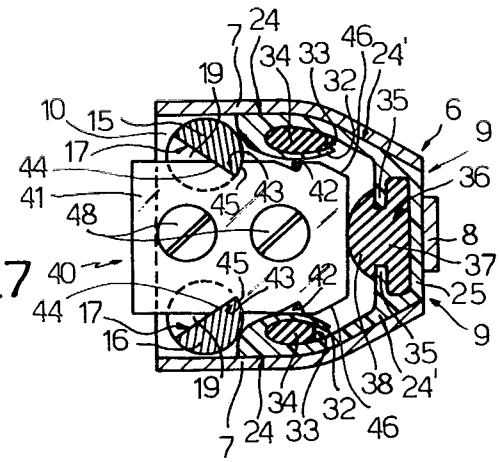
FIG. 7 is a section through part of the lock of FIG. 2, on the line VII—VII.
Figure 8:
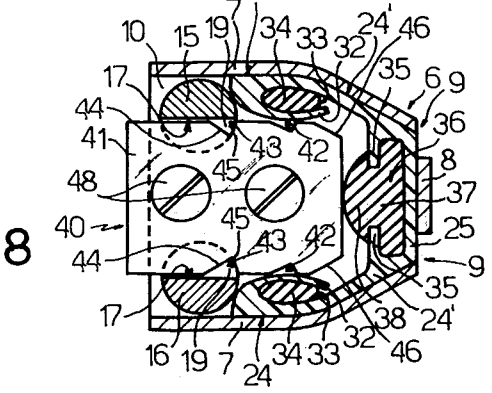
FIG. 8 is a section through part of the lock of FIG. 4, on the line VIII—VII.

As can be seen in FIGS. 7 and 8, the lateral walls 24 of the inner member 23 are bent inwards to define two appendices 32 which each give rise to a compartment 33 into which a respective rubber piece 34 is forced. The lateral end wall 25 inwardly forms a compartment in combination with two appendices 35 which branch inwards from the lateral walls 24', and into this compartment there is forced a rubber piece 36 comprising a base part 37 of rectangular section, inserted into said compartment, and a front part 38 in the form of a cylindrical portion.

A striker member 40 is arranged for engagement in said casing 6, and is constituted by a flat part 41, the lateral walls of which comprise two symmetrical pairs of notches 42 and 43, which serve to determine a first and second engagement position respectively between the striker member 40 and the engagement members 15 and 16, in the manner hereinafter described. Each of the notches 42 and 43 is constituted by a flat portion 44 so as to engage on the flat diametrical wall 17 of the members 15 and 16 (FIG. 7), and a curved portion 45 such as to engage on the cylindrical surface portion of the engagement members 15 and 16 (FIG. 7). The flat part 41 of the striker member 40 comprises terminal bevels 46 and two bores 47 into which two screws 48 are inserted (FIGS. 7 and 8). The screws also pass through a rear part 49 of the striker member 40 which is arranged for insertion into the slot 11 in the casing 6. The striker member 40 is fixed by its rear part 49 on to a fixed part, for example an upright of a motor vehicle door, by means of said screws 48.

The top of the pins 13 and 14 which emerge from the bosses 22 is of square section, and is fixed in a bore of square section in two respective engagement levers 51 and 52. The lever 51 comprises an arm 53, the end of which is bent upwards to form an appendix 54, and comprises a further upwardly bent appendix 55. The lever 52 comprises an arm 56 arranged to come into contact with the arm 53, a downwardly bent appendix 57 and a bore 58 into which is engaged the end of a cylindrical spring 59, the other end of which is engaged in a bore 60 provided in a bracket 61 bent upwards from the base plate 2. The bracket 61 also comprises a slot 62 which is almost completely circular, and in which is housed a bushing 63 mounted on a spindle 64 which is bent beyond the bushing 63 to form a control arm 65. On the other end of the spindle 64 there is mounted a bushing 66 which is housed in a slot 67 also nearly completely circular in shape, provided in a bracket 68 bent upwards from the base plate 2, at the end opposite the bracket 61. Beyond the bushing 66, the end of the spindle 64 comprises an orthogonally bent arm 71 which terminates in a short portion 72 bent along the axis of the spindle 64. The portion 72 is housed in a slot 73 in a safety control lever 74, which is pivoted on a lateral part 75 facing upwards from the support plate 1 by means of a pin 76 inserted into corresponding bores 77 and 78 provided respectively in the lever 74 and the part 75. The lever 74 also comprises an arm 80 which at its end comprises a bore 81 in which is connected a known member for operation from the inside of the vehicle (not shown), and comprises a further arm 82 with a bevelled end 83 and, in proximity thereto, a slot 84 and bore 85 in which is housed one end of a spring 86, the other end of which is inserted in a bore 87 provided in said lateral part 75. In proximity to the slot 73, the lever 74 comprises an appendix 88 which extends perpendicularly to said lever 14 and comprises a slot 89.

A bore 91 is provided in said lateral part 75 to house a pin 92 which also traverses a bore 93 in a lever 94 for controlling the lock from the inside of the vehicle. This lever 94 comprises an arm 95 carrying at its end a bent appendix 96, and also comprises an arm 97 with a bore 98 into which an operating member of known type (not shown) is connected. A bent appendix 99 is provided on the lateral part 75 to serve as a stop for the arm 97 of the lever 94, and a longitudinal slot 100 is also provided.

Said slot 100 movably houses one end 105 of an arm 106 of a lever 107 for controlling the lock from the outside of the vehicle, for example by a handle. The arm 106 derives from a central flat portion 108 of the lever 107, and comprises three orthogonally bent portions before the end 105. An arm 109 branches from the central portion 108 and comprises a first upwardly bent lateral appendix 110, and at its end a second upwardly bent appendix 111, this latter for operating the lever 107 by a known member, not shown. An arm 112 branches from the portion 108, and comprises a curved end portion 113 arranged to cooperate with the appendix 57 of the engagement lever 52. In said central portion 108 there is provided a part 114 disposed at an upper level, and a bore 115 in which is inserted a pin 116 which also passes through a bore 117 in the base plate 2, to pivot the lever 107 on the base plate 2. A spring 118 is disposed about the pin 116, one of its ends 119 resting on the appendix 55 of the disengagement lever 51, and its other end 120 resting on the appendix 110.

All the described component members of the lock according to the present invention are of metal, with the exception of the rubber parts 34 and 36, and the member 23 inside the casing 6, the rear part 49 of the striker member 40 and the 47 63 and 66 on the spindle 64, which are made of plastic.

The other represented embodiment of the lock according to the present invention, with reference to FIGS. 10 to 14, differs from that described in that the bore 115 in the lever 107 is not circular, but is in the form of a slot 120 to define two positions for the lever 107. The lever 107 also comprises a further arm 122 which at one end has an appendix 123 facing upwards, and is housed in a corresponding curved slot 124 provided in an extension part 125 of the appendix 88 of the safety lever 74. Finally, the slot 84 provided in the arm 82 of the safety lever 74 is of greater length, i.e. greater than the width of the end 105 of the lever 107, and substantially equal to the length of the slot 100.

The operation of the lock according to the present invention is as follows.

Figure 2:
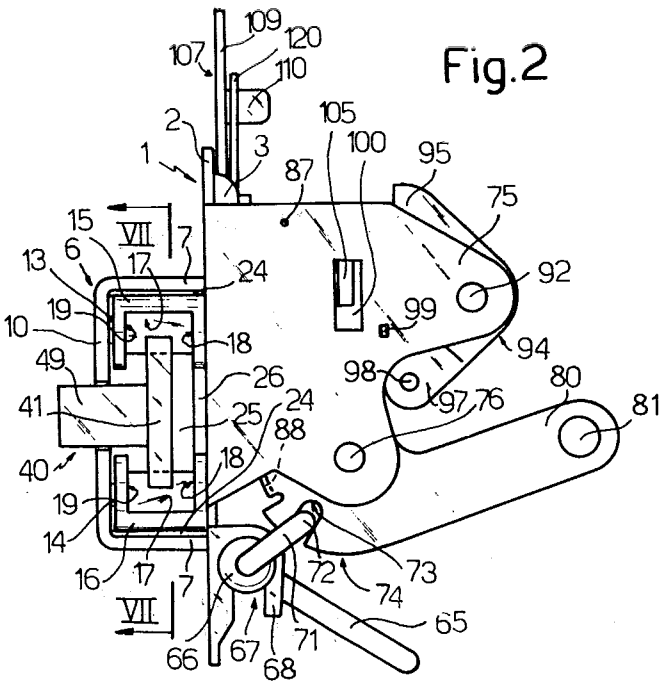

With reference to the embodiment of FIGS. 1 to 9, the lock of FIGS. 1 and 2 is shown in the closed position. In this position, as can be seen in FIG. 7, the lock assembly is engaged with the striker member 40 by the engagement members 15 and 16 engaging in the slots 43 in the flat part 41 of the striker 40. A portion of the flat diametrical part 17 and outer cylindrical surface of the members 15 and 16 are in fact coupled with the flat portions 44 and curved portions 45 of the notches 43. In this manner, the lock is well constrained overall to the striker member 40 without vibration, as the lateral walls and end wall of the flat part 41 of the striker member 40 are enclosed between the appendices 32 subjected to the resilient action of the rubber parts 34 and the rubber part 36. A high resistance to applied loads is obtained, in particular to the disengagement load acting in a direction transverse to the vehicle, in that this disengagement load, which is exerted in a direction such as to separate the members 15 and 16 from the striker member 40, and thus acting between the engaged curved surfaces of the members 15 and 16 and the portions 45 of the notches 43, gives rise to action and reaction forces which consist only of components passing through the axis of the pins 13 and 14 of the respective members 15 and 16. There are, therefore, no moments to be opposed as in known locks, and thus the resistance to the disengaging or transverse load on the lock of the present invention is very high, and well above the limits imposed by safety standards (loads up to 1500 Kgf have been applied under test, without the lock becoming deformed), and without having to over-dimension the other parts of the lock mechanism, which is thus of relatively simplified construction. Furthermore, the resistance to longitudinal loads is also high, as the connection between the casing 6 and the base plate 2 of the support plate 1, obtained by fixing the appendices 5 into the slots 4, is sufficiently strong to oppose the force exerted by the flat part 41 of the striker member 40 on the lower planes 19 of the engagement members 15 and 16.

The lock according to the present invention is very simple to manipulate. When it is required to open the lock by operation from the outside of the door, the appendix 111 of the lever 107 is operated in known manner, so that this latter rotates counterclockwise through a certain distance, and (FIGS. 3 and 4) the end portion 113 of the arm 112 encounters the appendix 57 of the disengagement lever 52 to cause it to turn clockwise through about 45°. The simultaneous rotation of the arm 56 of the lever 52 causes a like rotation of the arm 53 and hence of the disengagement lever 51. There is thus a simultaneous rotation of about 45° of the pins 13 and 14, and correspondingly of the engagement members 15 and 16, which assume the configuration shown in FIG. 8. In this position the engagement members 15 and 16 are no longer engaged in the notches 43, and the lock can be disengaged from the striker member 40. This disengagement stage is facilitated by the resilient force exerted by the rubber parts 34 and 36 on the flat part 41 of the striker member 40. After this disengagement stage has taken place, the levers 51 and 52, which are thrust respectively by the end 119 of the spring 118 acting on the appendix 55 of the lever 51, and by the spring 59 acting on the lever 52, and are no longer subjected to the action of the end portion 113 of the lever 107 (which has returned to its initial position) also return to said initial position, but beyond the position of FIG. 1, into a position defined by a stop for the arm 56 of the lever 52, determined by its resting on the lateral part 75 of the support plate 1. During this movement of the lever 107, the end 105 of the arm 106 of the lever 107 has moved along the slot 100 to effect the disengagement of the lock, thereby assuming an extreme position as shown in FIG. 4. This movement of the end 105 of the arm 106 can also be obtained by direct action of the appendix 96 of the lever 94 on said end 105, by rotating the lever 94 by means of a known control member connected to the bore 98, and operable from the inside of the vehicle. There is thus the same counterclockwise rotation of the lever 107 and thus the same degree of rotation of the end portion 113 which operates on the appendix 57 of the lever 52 in the manner already described for opening the lock.

Figure 3:
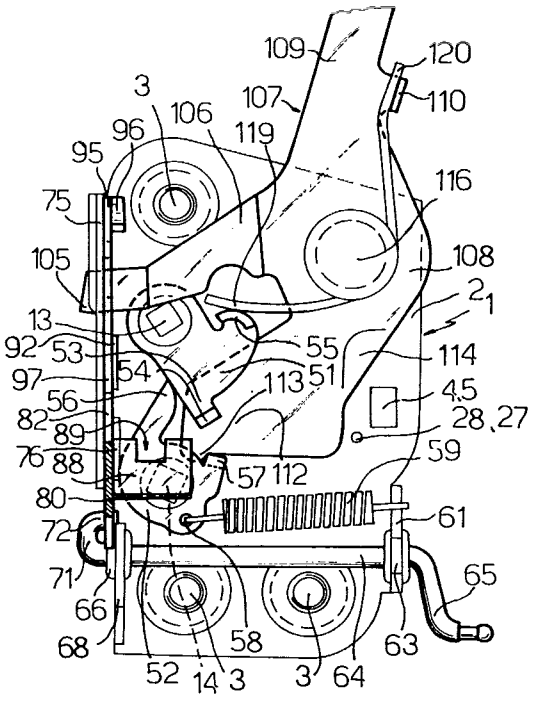
FIGS. 3 and 4 are a plan and side view respectively, of the lock of FIG. 1, in the open position.
Figure 5:
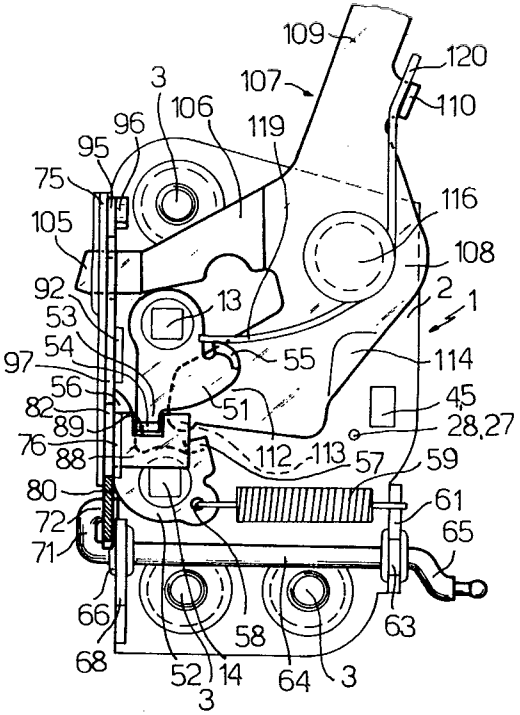
FIGS. 5 and 6 are a plan and side view respectively, of the lock of FIG. 1, with the safety device inserted.
Figure 4:
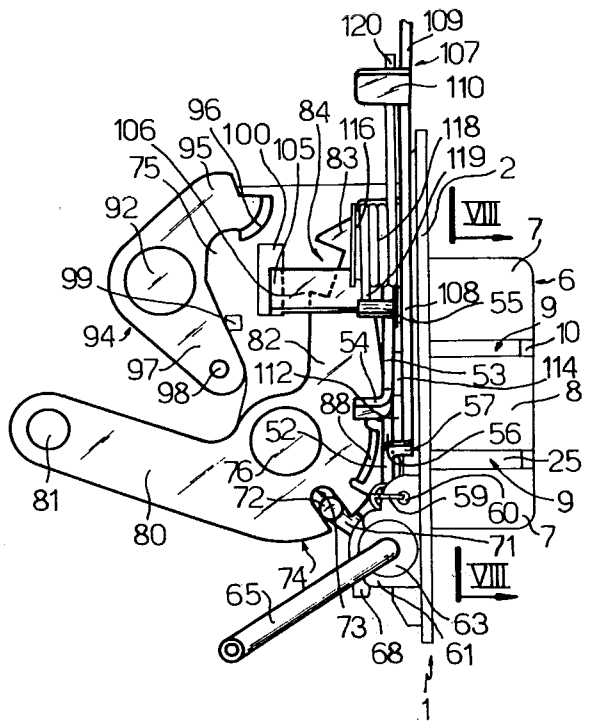
Figure 6:
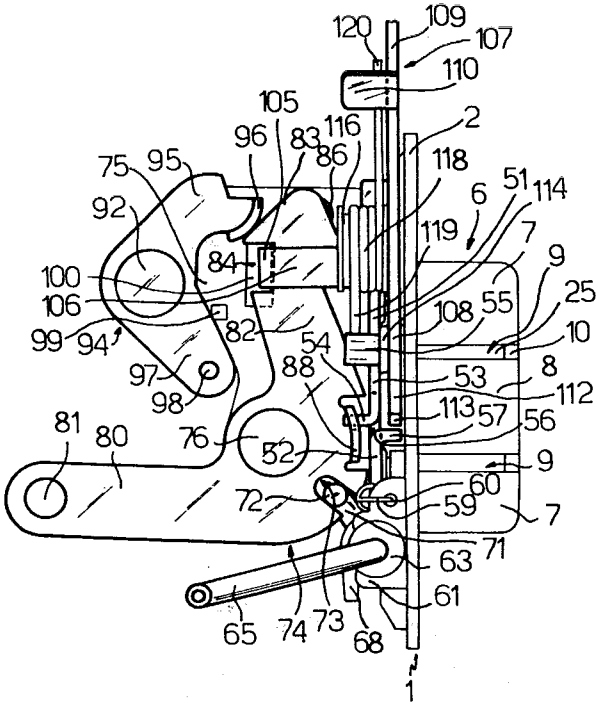

If it is required to prevent the lock from opening, the lever 74 is moved from the position shown in FIGS. 3 and 4 to the position shown in FIGS. 5 and 6. This is done by turning the lever 74 through a certain distance counterclockwise such that, as shown in FIG. 6, the slot 84 blocks the end 105 of the arm 106 in such a manner that the lever 107 can no longer be operated. The position assumed by the bevelled end 83 of the arm 82 of the safety lever 74 also prevents the appendix 96 of the lever 94 from acting on the end 105, and thus also prevents the lever 107 being operated by way of the control lever 94 from the inside of the vehicle. When the safety control lever 74 is inserted, it also directly prevents any movement of the disengagement levers 51 and 52, as the slot 89 in the appendix 88 (FIG. 5) receives the appendix 54 of the lever 51, and consequently the arm 53 also blocks the arm 56 of the lever 52. The safety lever 74 is operated by means of two controls, either directly from the inside of the vehicle by means of a member (not shown) which is connected to the arm 80 through the bore 81, or by a key which, in known manner, operates the arm 65 of the spindle 64 to cause rotation of the portion 72 housed in the slot 73 in the lever 74.

When the lock is open, in order to engage it, it is only necessary to push the door on which the lock mechanism is disposed, towards the fixed striker member 40, whereupon the flat part 41 causes the engagement members 15 and 16 to turn through a certain distance until they become positioned successively in the notches 42 and 43, to assume the final closure position shown in FIGS. 1, 2 and 7.

The operation of the lock according to the present invention is analogous to that described heretofore even when the members 15 and 16 engage with the notches 42 instead of with the notches 43 as described. In this case, a first closed position of the lock is obtained in which the connection between the striker member 40 and the lock mechanism is less rigid. Furthermore, as the inclination of the portions 44 of the notches 42 is different from that of the notches 43, the position assumed by the levers 51 and 52 in said first closed position is different than in the case of the normal closed position, and operation of the safety lever 74 is prevented in that the appendix 54 is not in a position corresponding with the slot 89 (the same obstacle exists in the lock disengagement position).

Figure 11:
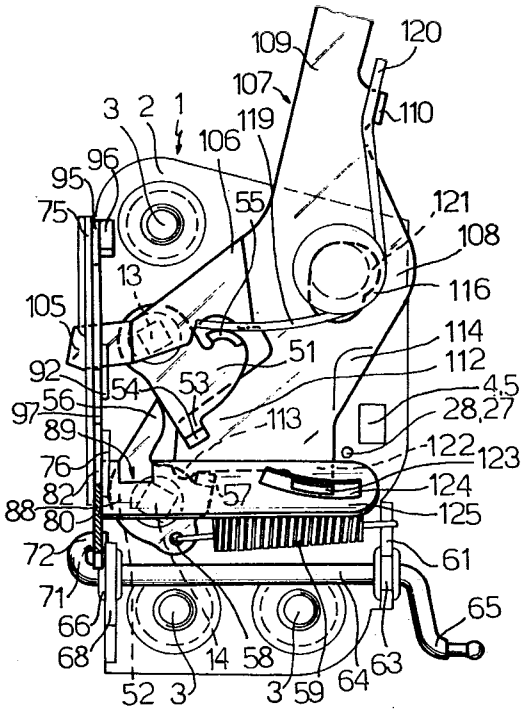
FIGS. 11 and 12 are a plan and side view respectively, of the lock of FIG. 10, in the open position.
Figure 13:
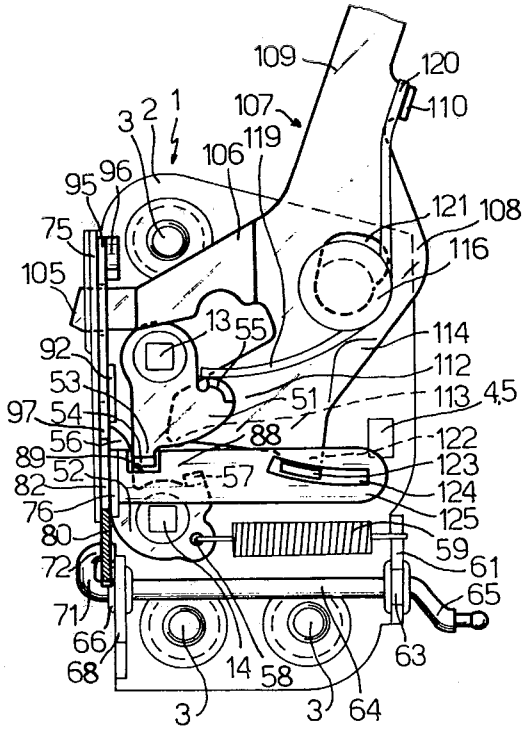
FIGS. 13 and 14 are a plan and side view resectively, of the lock of FIG. 10, with the safety device inserted.
Figure 12:
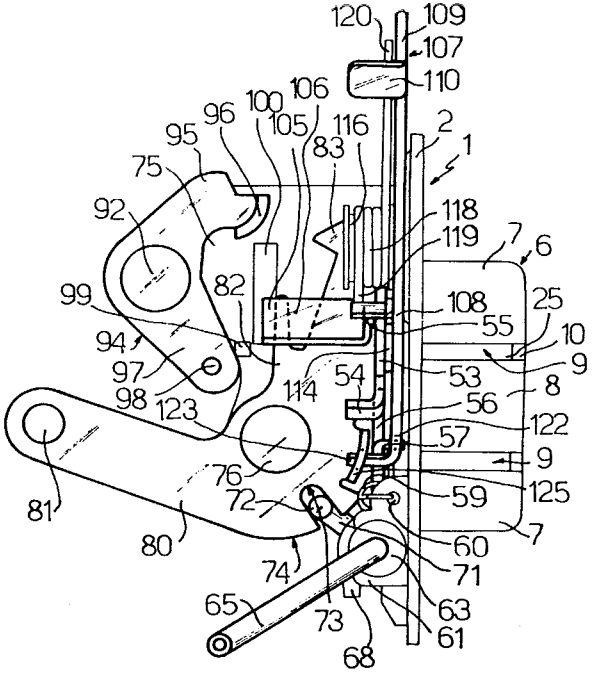
Figure 14:
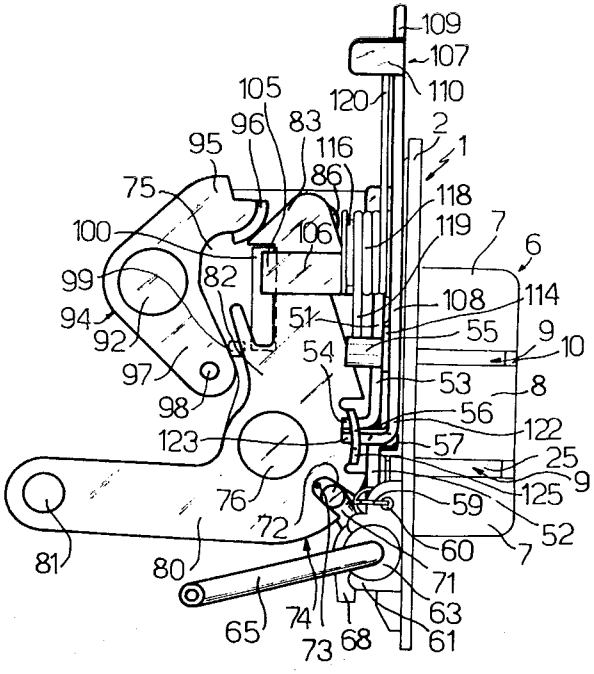

The operation of the lock of the second embodiment, illustrated in FIGS. 10 to 14, is substantially analogous to the described operation for the lock of FIGS. 1 to 9. There is only the additional characteristic that when the lever 74 is in the position such that the safety device is inserted (FIGS. 13 and 14), the lever 107 for operation from the outside is not locked, but in fact can be rotated without causing any operation of the lock mechanism. In this respect, when the lever 74 is turned counterclockwise, it causes the appendix 88 with the part 125 to displace, and hence move the lever 107, which is connected to the part 125 via the appendix 123. This movement of the lever 107 is allowed because the coupling between the lever 107 and pin 116 is by way of the slot 121. Thus in this new configuration assumed by the lever 107, any movement of the lever 107, which can take place because the appendix 123 can move in the slot 124 and the end portion 105 of the arm 106 can move in the slot 100, does not give rise to any contact between the end portion 113 of the arm 112 and the appendix of the lever 52, and thus no operation of the levers 52 and 51. The fixed position of the levers 51 and 52 is therefore always maintained by the positioning of the appendix 54 of the lever 51 in the slot 89 in the appendix 88. When the safety lever is withdrawn, it leads to a clockwise rotation through a certain extent, of the lever 74 so that it assumes the configuration of FIG. 10. During this movement the part 125 drags the appendix 123 and thus the lever 107, which again assumes the position of FIG. 10, so that operation of the lever 107 causes the end portion 113 of the arm 112 to make contact with the appendix 57 of the lever 52, as shown in FIGS. 11 and 12, and thus determine the operation of the levers 51 and 52 and the disengagement of the members 15 and 16 from the striker member 40, as described. The lever 107 and thus the appendix 123 can make this movement because of the size of the slot 124 (FIG. 11).

In addition to the important described advantages such as high resistance to force, in particular to the disengagement load, and a relatively simple construction both of the striker member 40 and casing 6 and of the other lock mechanism members, the lock of the present invention has other advantages, namely the fact that the safety lever 74 inserts a double safety device, in that not only does it prevent movement of the lever 107 or makes its movement insufficient, but by way of the slot 89 it directly prevents any movement of the levers 51 and 52. Furthermore, the fact that the lever 107 can be moved into an idle position by way of the slot 121 prevents any forcing of the lever 107 when the safety device is inserted.

Finally, it is apparent that modifications to the shape, arrangement and materials of the various constituent parts can be made to the described embodiments of the lock according to the present invention, without leaving the scope of the inventive idea contained therein. Other accessory means can also be fitted, such as spring means for stabilizing the two positions assumed by the lever 107 in the slot 121.

What we claim is:

1. A lock for motor vehicle doors, comprising a striker member arranged for engagement and disengagement by means comprised in a mechanism of said lock, the mechanism being supported by a first plate, and the striker member and means being disposed on a part fixed relative to the door and on the door respectively, or vice versa, wherein said means comprise at least one pair of engagement members for said striker which are rotatable on pins, and the disengagement load exerted between said member and said means is opposed only by component forces passing substantially through the axis of said pins, wherein the contact engagement between said pair of engagement members and said striker member occurs, at least partially, on surfaces which are concentric about the axis of said pins, and pertain respectively to said engagement members and striker member.

2. A lock as claimed in claim 1, wherein the external shape of each of said engagement members is defined by at least one cylindrical surface portion.

3. A lock as claimed in claim 2, wherein the external shape of each of said engagement members is defined by a flat surface portion in addition to said cylindrical surface portion.

4. A lock as claimed in claim 3, wherein said flat surface portion passes through the axis of said pins.

5. A lock as claimed in claim 3, wherein the height of said flat surface portion is less than the height of said engagement members, so as to define for said engagement members two flat surface portions perpendicular to the axis of said pins, to constitute the bases of two cylindrical end parts of said engagement members.

6. A lock as claimed in claim 1, wherein said striker member comprises a first portion for engagement with said engagement members, said first portion comprising at least one pair of slots for engagement by said pair of said members.

7. A lock as claimed in claim 6, wherein said first portion is flat and said pair of slots are disposed at the sides of said portion.

8. A lock as claimed in claim 6, wherein each of said slots comprises at least one portion with a profile in the form of part of a circle, and at least one portion of straight profile.

9. A lock as claimed in claim 6, wherein said striker member comprises a second portion having a smaller section than the first portion, and fixed to the first portion, and arranged to be fixed to said part which is fixed relative to said door.

10. A lock as claimed in claim 1, wherein when said striker member is engaged by said pair of engagement members, it is subjected to the resilient action of rubber pieces contained in a member fixed to said first plate supporting the mechanism of said lock; said resilient action facilitating the locking of said striker member in said member, and facilitating the separation of said pair of engagement members from said striker member during the disengagement stage.

11. A lock as claimed in claim 10, wherein said rubber parts are at least partly contained in a housing housed in said member; said resilient action on said striker member being exerted directly by said rubber pieces.

12. A lock as claimed in claim 10, wherein the two ends of said pins of said engagement members are inserted in a seat in said member and in a seat in said first plate.

13. A lock as claimed in claim 1, wherein those ends of said pins lying above said first plate are each connected to a disengagement lever, said disengagement levers being operated by a control lever.

14. A lock as claimed in claim 13, wherein said control lever comprises a first and second arm for operating the door from the outside and inside, and a third arm for operating said disengagement levers.

15. A lock as claimed in claim 14, wherein said third arm is arranged to act on an appendix of a first of said disengagement levers to cause it to rotate, and said first disengagement lever is provided with an arm arranged to act on the other of said disengagement levers to cause it to make a corresponding rotation; said rotations of said disengagement levers being transmitted, by way of said pins, to said engagement members of said striker member.

16. A lock as claimed in claim 13, wherein resilient means are provided for acting on said disengagement levers, and arranged to dispose said engagement members in the position in which they are engaged by said striker member; said resilient means enabling said position to be momentarily abandoned during the stage in which said engagement members become engaged by said striker member.

17. A lock as claimed in claim 13, comprising a safety lever arranged to directly block any movement of said disengagement levers.

18. A lock as claimed in claim 17, wherein said safety lever comprises an appendix with a slot, an appendix of one of said disengagement levers being received in said slot by the operation of said safety lever.

19. A lock as claimed in claim 17, wherein means combined with said safety lever are provided for disposing said control lever in a position in which it can be operated, but without resulting in any action on said disengagement levers.

20. A lock as claimed in claim 19, wherein said means comprise an appendix of said control lever inserted in a slot in a portion of said safety lever, and a second slot provided in said control lever through which passes a peg which pivots it on to said first plate, in such a manner that a movement of said safety lever causes said appendix to displace said control lever, this displacement being allowed by said second slot through which said peg passes.

21. A lock as claimed in claim 20, comprising means for maintaining said control lever in two positions to provide two stable positions of said slot relative to said peg.

22. A lock as claimed in claim 17, comprising means for preventing operation of said safety lever when said lock mechanism is disengaged from said striker member.

23. A lock as claimed in claim 17, wherein said striker member comprises a first portion for engagement with said engagement members, said first portion comprising at least one pair of slots for engagement by said pair of said members and comprising at least two of said pairs of slots arranged to define two positions in which said striker member is engaged with said pair of said elements, and comprising means for preventing operation of said safety lever in one of said two positions.

24. A lock as claimed in claim 23, wherein each of said slots comprises at least one portion with a profile in the form of part of a circle, and at least one portion of straight profile and wherein said means for preventing operation of said safety lever in one of said two positions comprise a different inclination of said straight-line profile portion of said slots of the two pairs.

25. A lock as claimed in claim 10, wherein said rubber parts are at least partly contained in a housing housed in said member and having flexible parts; said resilient action on said striker member being exerted by said rubber pieces by way of said flexible parts of said housing.

* * * * *

UNITED STATES PATENT AND TRADEMARK OFFICE

CERTIFICATE OF CORRECTION

PATENT NO. : 4,288,117
DATED : September 8, 1981
INVENTOR(S) : Giovanni Nardi

It is certified that error appears in the above-identified patent and that said Letters Patent are hereby corrected as shown below:

Column 2, line 19, delete "VII" and insert --VIII-- therefor.

Column 2, line 26, delete "resectively" and insert --respectively-- therefor.

Column 4, line 38, delete "47" and insert --bushings-- therefor.

Signed and Sealed this

*Twenty-fourth* Day of *November 1981*

[SEAL]

*Attest:*

GERALD J. MOSSINGHOFF

*Attesting Officer* *Commissioner of Patents and Trademarks*